US011904232B2

(12) United States Patent
Gordon

(10) Patent No.: US 11,904,232 B2
(45) Date of Patent: Feb. 20, 2024

(54) GAME TABLE SYSTEM

(71) Applicant: Jim Gordon, Nokomis, FL (US)

(72) Inventor: Jim Gordon, Nokomis, FL (US)

( * ) Notice: Subject to any disclaimer, the term of this patent is extended or adjusted under 35 U.S.C. 154(b) by 215 days.

(21) Appl. No.: 17/230,781

(22) Filed: Apr. 14, 2021

(65) Prior Publication Data

US 2022/0331687 A1 Oct. 20, 2022

(51) Int. Cl.

| | |
|---|---|
| ***A63F 1/06*** | (2006.01) |
| ***A47B 3/08*** | (2006.01) |
| ***A47B 13/16*** | (2006.01) |
| ***A63F 1/18*** | (2006.01) |
| ***A63F 1/10*** | (2006.01) |

(52) U.S. Cl.

CPC ..... *A63F 1/067* (2013.01); *A47B 3/08* (2013.01); *A47B 13/16* (2013.01); *A63F 1/10* (2013.01); *A63F 1/18* (2013.01)

(58) Field of Classification Search

CPC .. A63F 1/067; A63F 2003/00981; A63F 1/10; A63F 1/18; A47B 3/08; A47B 13/16; A47B 2200/0085; A47B 2200/0086

See application file for complete search history.

(56) References Cited

U.S. PATENT DOCUMENTS 1,894,146 A * 1/1933 Baker ..... A47B 13/16 248/289.11
2,201,187 A * 5/1940 Levin ..... A63F 1/06 273/148 A
2,926,918 A * 3/1960 Morgan ..... A63F 1/10 273/150
3,270,694 A * 9/1966 Wallace ..... A47B 13/16 108/26
4,099,470 A * 7/1978 Cannon, Jr. ..... A47B 25/00 D6/707.22
5,169,108 A * 12/1992 Carlson ..... A47B 13/16 248/315
5,586,509 A * 12/1996 Mangold ..... A47B 13/16 108/65
7,172,164 B2 * 2/2007 Fuelling ..... A01K 97/10 248/314
9,683,696 B2 * 6/2017 McCullough ..... F16M 13/022
2001/0038910 A1 * 11/2001 MacQueen ..... C09D 7/65 428/327
2012/0266789 A1 * 10/2012 Peery ..... A47B 87/02 108/91
2015/0021284 A1 * 1/2015 Ashley ..... A47B 23/04 403/345
2018/0338623 A1 * 11/2018 Winterhalter ..... A47G 23/0225
2020/0023255 A1 * 1/2020 Webb ..... A63B 67/04

* cited by examiner

*Primary Examiner* — Michael D Dennis
(74) *Attorney, Agent, or Firm* — Cynthia S. Lamon; Lamon Patent Services

(57) ABSTRACT

The present invention relates to a game table system for modular and adjustable configuration by a user. The game table system comprises an auxiliary member chosen by the user to be optionally adjoined to different areas of a table top or at least one leg of the game table system. The auxiliary member aiding in ease of access to various articles that may aid the user in conducting the game played upon the game table system. The auxiliary members may be removably adjoined so that one or more auxiliary members can be removed before storage.

12 Claims, 11 Drawing Sheets

Detail A

GAME TABLE SYSTEM

BACKGROUND OF THE INVENTION

1. Field of the Invention

The present invention relates to a game table for a custom configuration by a user.

2. Description of Related Art

Modular folding tables are commonly used for gaming surfaces in different locations. Tables with foldable legs enabled to stack upon each other are often of a limited size. Various games require different equipment to play, including but not limited to, betting chips, cards, game boards, notepads, and more. When games of more than two players are conducted on the same table, the table can get crowded with game boards, cards, food, beverages, and more. When crowding occurs, a player at the table may lose access to all areas of the table. A solution is needed for improved access and storage of articles during the play of a game upon a folding table.

Issues also arise when a table is constructed as a fixed design and shape. Commonly players sitting within a chair near or under the table may have a hard time accessing all parts of the table if their feet cannot fit comfortably under the table. Secondly, a fixed design allows for no modification to game types requiring specific equipment played upon the same table. For example, a game of poker may require a poker chip holder, while a board game may require a bin or receptacle to hold discarded game pieces. Improvements to table configuration are needed to match different games played upon the same table and for optimized storage of game tables.

BRIEF SUMMARY OF THE INVENTION

The present invention relates to a game table system for modular and adjustable configuration by a user. The game table system comprises an auxiliary member chosen by the user to be optionally adjoined to different areas of a table top or at least one leg of the game table system. The auxiliary member aiding a user in ease of access to various articles used while playing a game upon the game table system. The auxiliary members may be removably adjoined so that one or more auxiliary members can be detached before storage. By removing the auxiliary members, the game table system allows the user transportable and configurable storage, without the worry of breaking or damaging the auxiliary member during movement of the game table system.

Another object of the present invention is to provide a lip wherein multiple units of the game table system may be aligned and stacked for secure storage. The lip further allows for flush stacking, resulting an optimal use of storage space.

Another object of the present invention is to provide at least one handle slot wherein the user may move or lift the game table system when stacked upon other units of the game table system or when the game table system is fully assembled.

In order to do so, a game table system is provided, the game table system having a table top wherein a game is played upon. In some embodiments, the table top includes a top surface, a bottom surface, and a perimeter edge. In some embodiments, at least four legs are rotatably adjoined to the bottom surface of the table top and allow for the user to collapse the legs when desired. In some embodiments, upon the perimeter edge of the table top at least one first attachment member is adjoined. During play of the game, at least one auxiliary member having at least one second attachment member may be adjoined to the at least one first attachment member. The second attachment member interfaces with the first attachment member allowing the user to adjust the position of the auxiliary member as desired.

BRIEF DESCRIPTION OF THE SEVERAL VIEWS OF THE DRAWINGS

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION OF THE INVENTION

Figure 1:
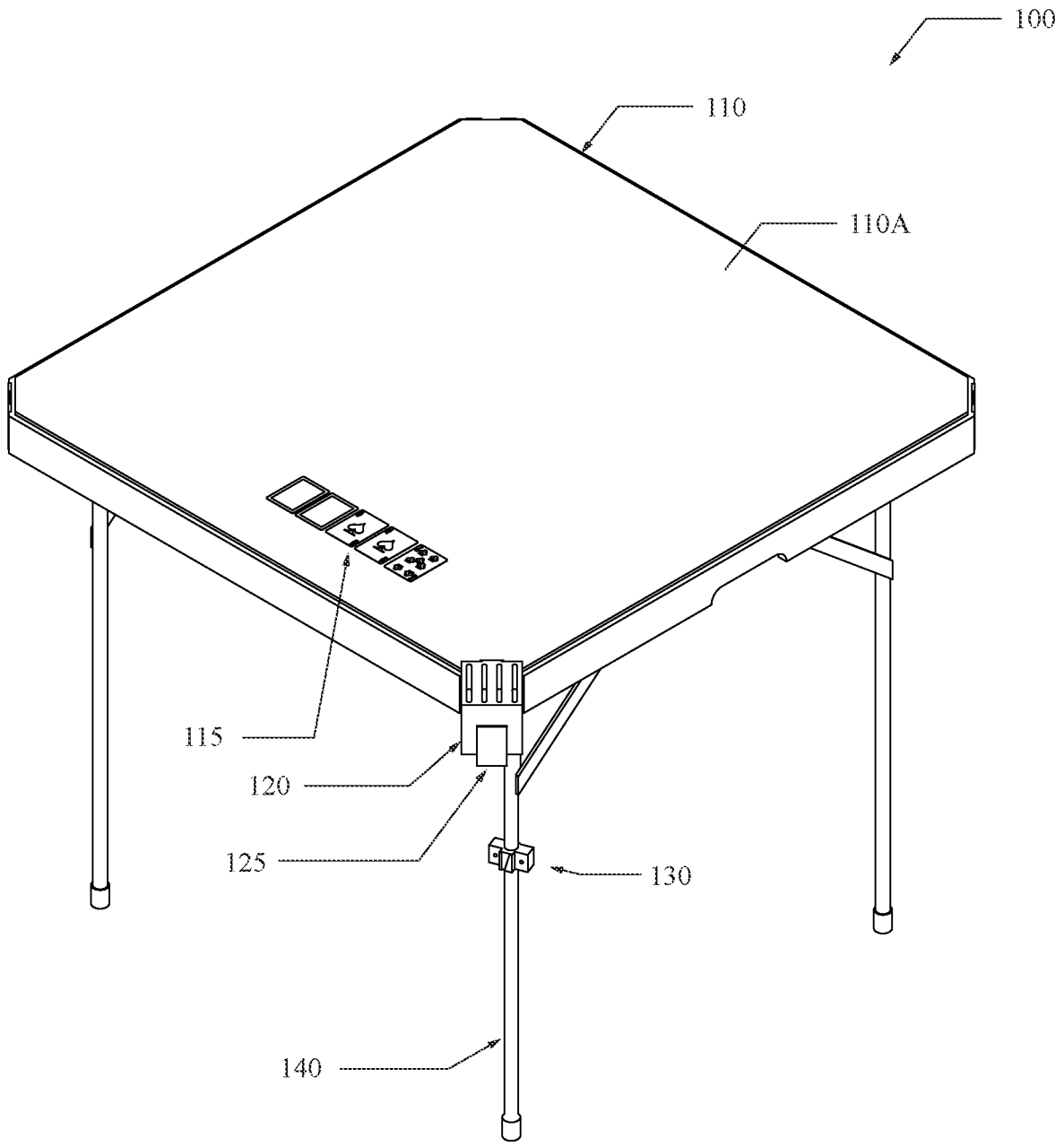
FIG. 1 shows a perspective view of one embodiment of the game table system.

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

As shown in FIGS. 1-4, the present invention relates to a game table system 100 comprising a table top 110 having a top surface 110A, a bottom surface and a perimeter edge 110B. In some embodiments, a leg 140 of the game table system 100 is rotatably adjoined to the bottom surface of the table top 110. In some embodiments, the game table system 100 includes at least one leg 140. In some embodiments, the bottom surface of the table top 110 may further comprise multiple indentations and/or reinforcing members to increase a bearing load of the game table system 100. In other embodiments, the bottom surface of the game table system 100 may further include a bottom indentation, not shown, that is shaped and sized to have the leg 140 fit within. Configuration of the game table system 100 begins with a first attachment member 150 adjoined to the perimeter edge 110B of the table top 110. As the user plays a game upon the game table system 100, at least one auxiliary member 120 may be moved or interchanged.

Figure 8A:
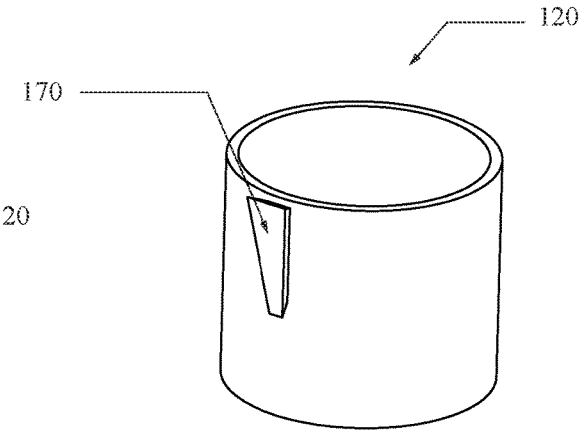
FIG. 8A shows an exemplary isometric view of one embodiment of the auxiliary member of the game table system.
Figure 8B:
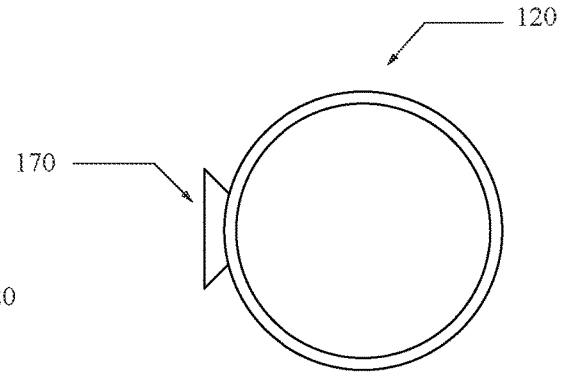
FIG. 8B shows an exemplary top view of one embodiment of the auxiliary member of the game table system.

In some embodiments, the at least one auxiliary member 120 comprises a second attachment member 170, which may be adjoined to the table top 110. Advantageously, the auxiliary member 120 is configurable by the user to match the game played upon the game table system 100. For example, the auxiliary member 120 may hold a game article 115, such as a playing card, when a game such as poker is played upon the game table system 100. The second attachment member 170 is comprised of a shape and size to interface with the first attachment member 150 during assembly by a user. For example, the auxiliary member 120 may be a cupholder, as shown in FIGS. 8A and 8B, having a dovetail mount male member as the second attachment member 170 and a dovetail mount female member as the first attachment member 150 allowing for the secure mounting of the auxiliary member 120 to the table top 110.

Figure 2:
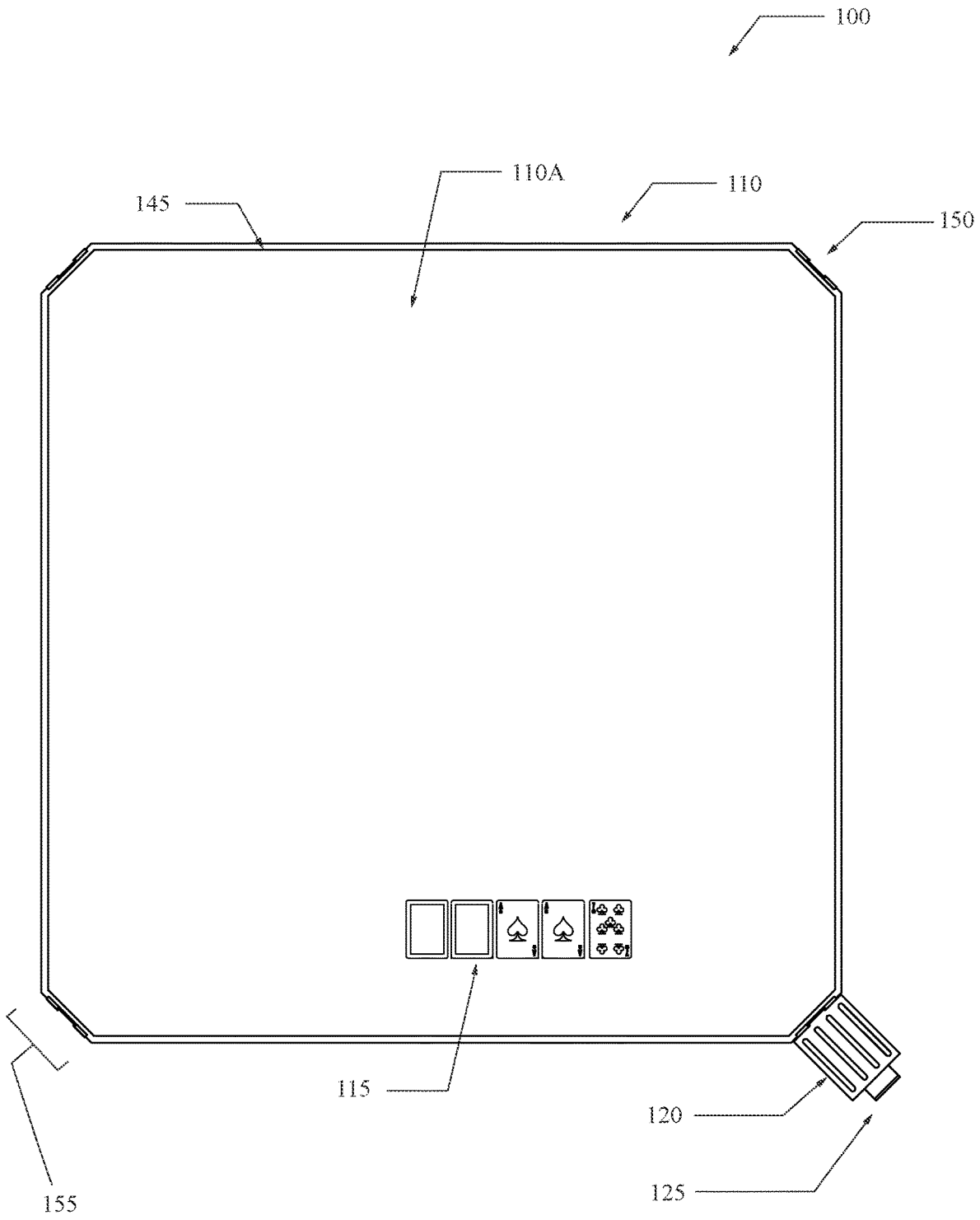
FIG. 2 shows an exemplary top view of one embodiment of the game table system.
Figure 3:
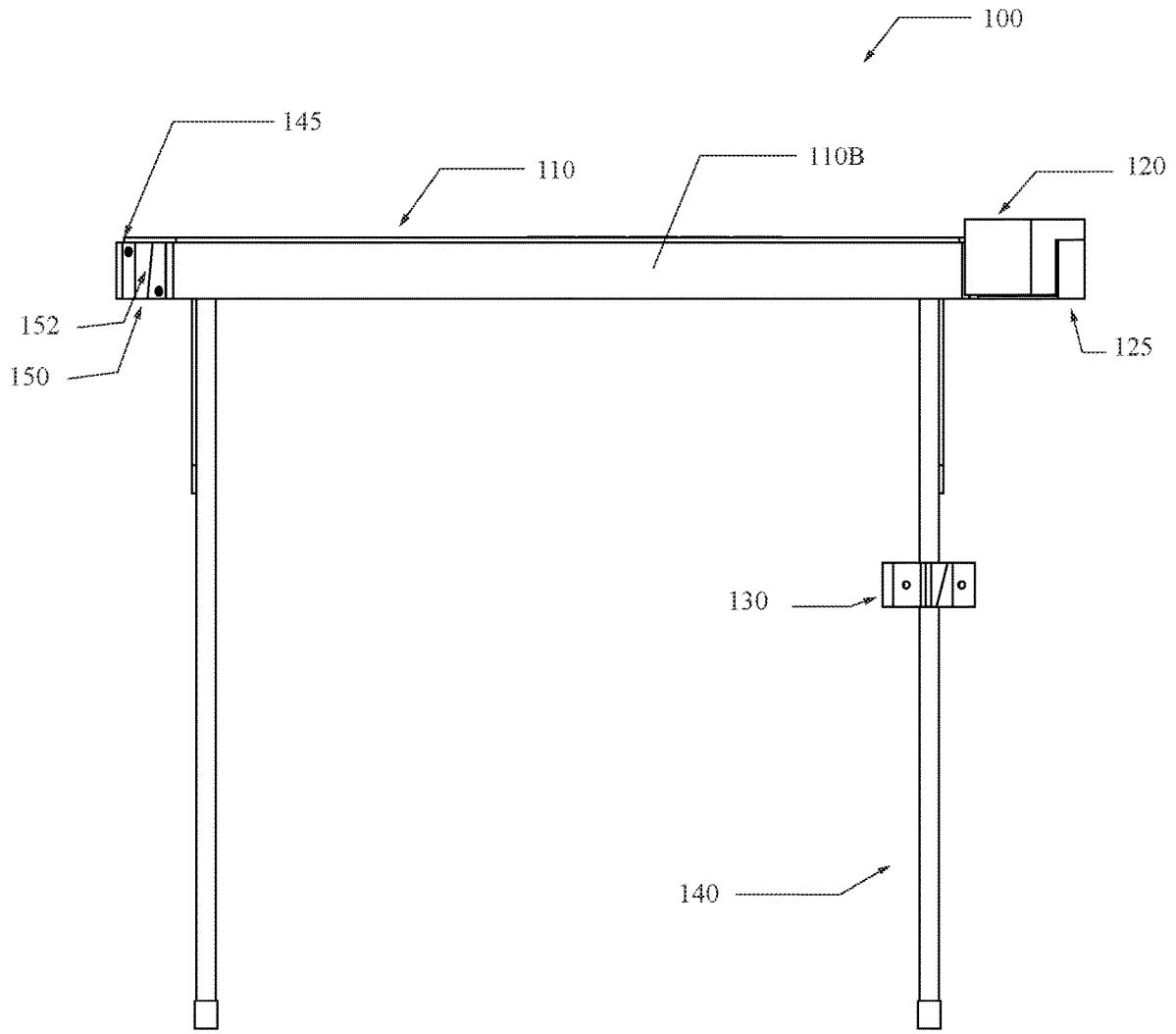
FIG. 3 shows an exemplary elevation view of one embodiment of the game table system.
Figure 4:
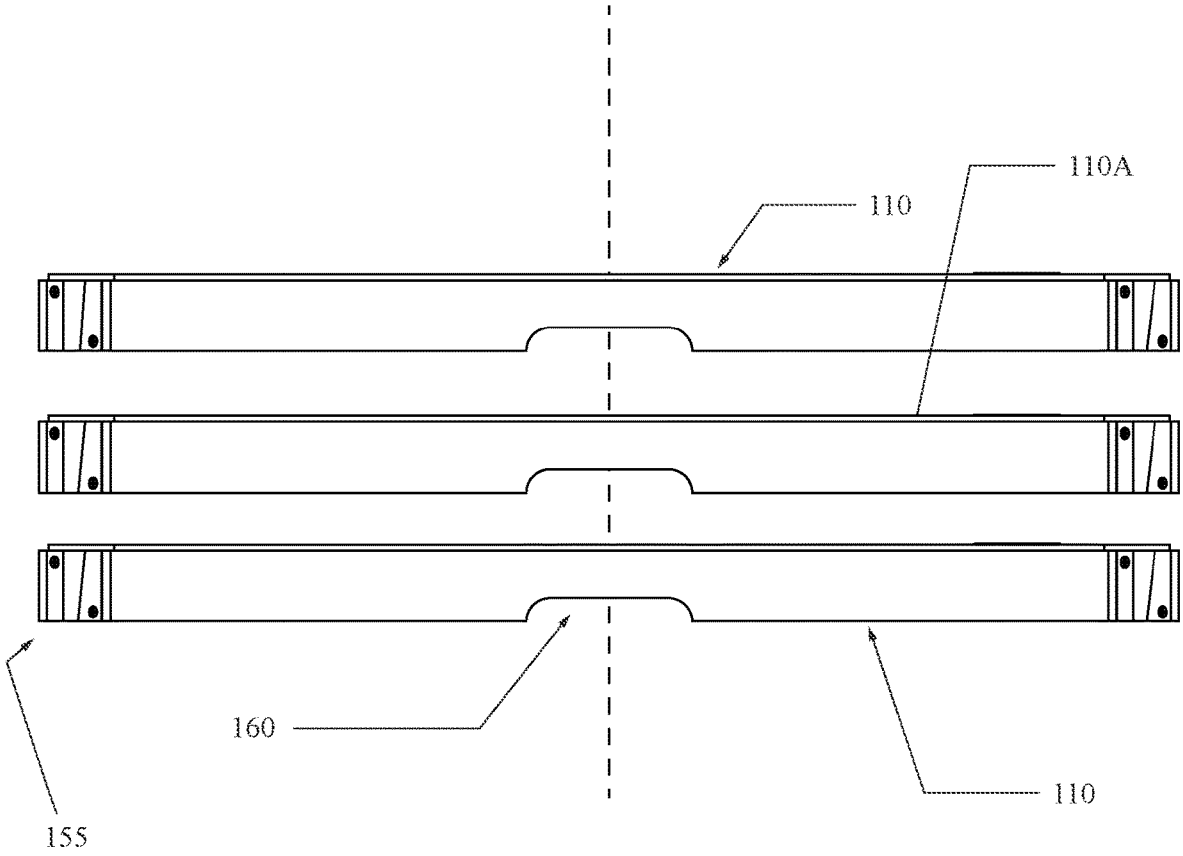
FIG. 4 shows an exemplary front view of one embodiment of the game table system being stacked.

It should be understood, that the present invention is not limited to the locality of the first attachment member 150 being within a chamfered corner 155 of the table top 110. In some embodiments, the first attachment member 150 may be located at any location along the perimeter edge 110B of the table top 110. In some embodiments, the table surface 110A is recessed on the table top 110 from an edge 110B defining a perimeter of the table top 110 forming lip 145, as best seen in FIG. 2. In some embodiments, the lip 145 extends into the top surface 110A of the table top 110 and is shaped to substantially match the perimeter edge 110B. As shown in FIG. 4, the game table system 100 may be configured for easy stacking by the user, wherein the lip 145 is configured to aid in the alignment and stacking of more than one unit of the game table system 100. Advantageously, the lip 145 allows the user to stack multiple units of the game table system 100 in a flush and accessible manner, as the bottom surface 110C of the table top 110 may have a bottom surface indentation, not shown, to substantially match the size and shape of the lip 145. In some embodiments, the table top 110 further comprises at least one handle slot 160 protruding into the table top 110 from the perimeter edge 110B and configured to be gripped by a hand of a human. In some embodiments, the first attachment member 150 may protrude into or in proximity to the lip 145. The lip 145 may also assist the user with alignment of the second attachment member 170 of the auxiliary member 120 with the first attachment member 150 during assembly. In some embodiments, the game table system 100 includes at least one first attachment member 150 adjoined to the table top 110. Another embodiment provides at least one second attachment member 170.

Figure 5A:
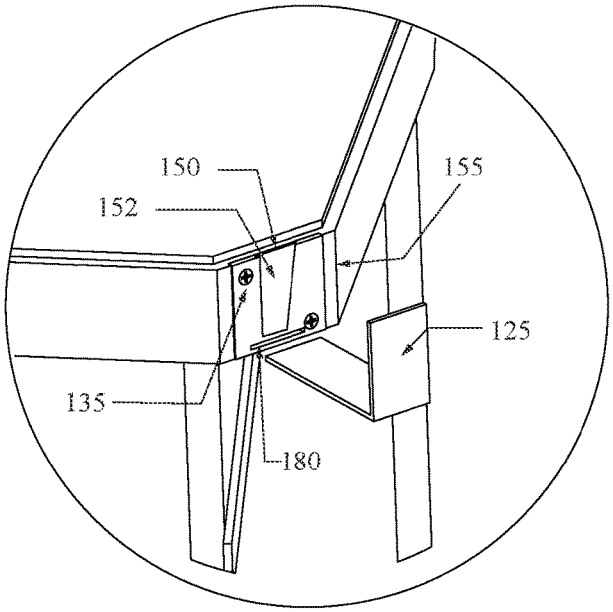
FIG. 5A shows an exemplary detail view of one embodiment of the game table system as shown in Detail A of FIG. 5.
Figure 5:
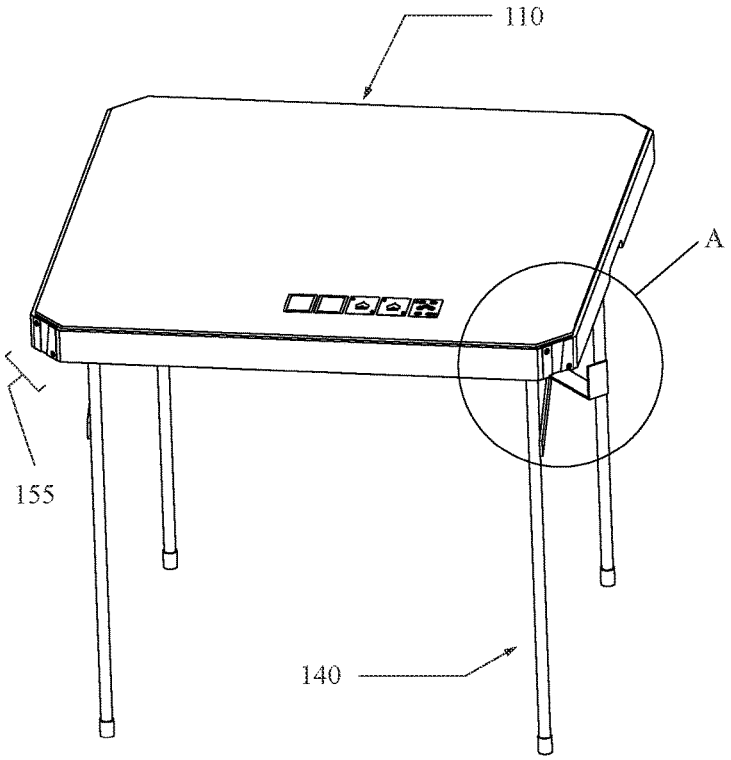
FIG. 5 shows a perspective view of one embodiment of the game table system.
Figure 6A:
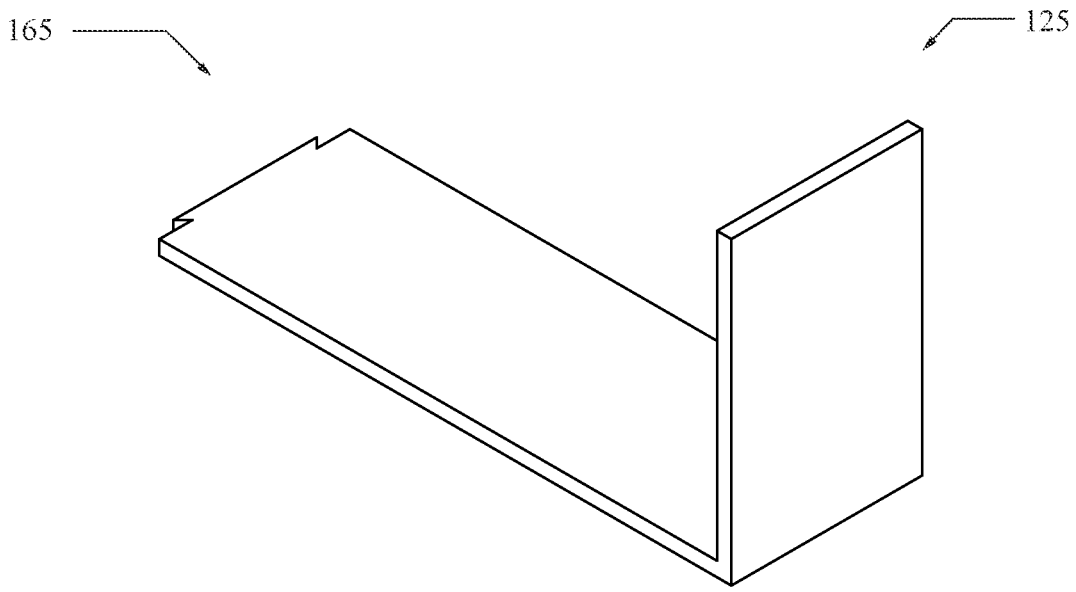
FIG. 6A shows an exemplary isometric view of one embodiment of the support bracket of the game table system.
Figure 6B:
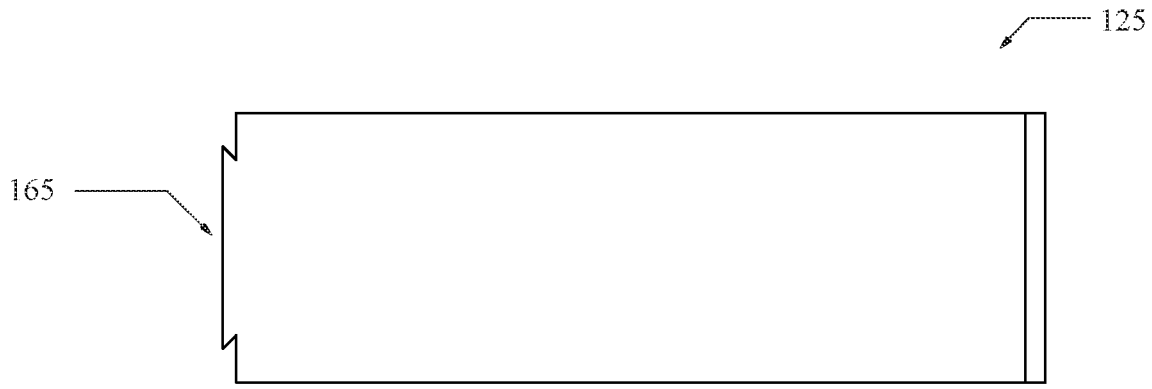
FIG. 6B shows an exemplary top view of one embodiment of the support bracket of the game table system.
Figure 7A:
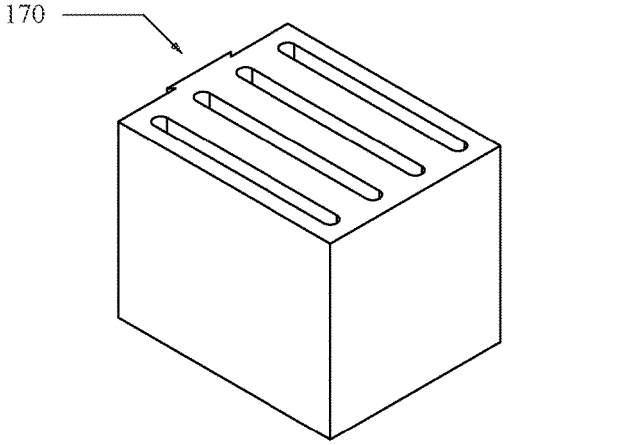
FIG. 7A shows an exemplary isometric view of one embodiment of the auxiliary member of the game table system.
Figure 7B:
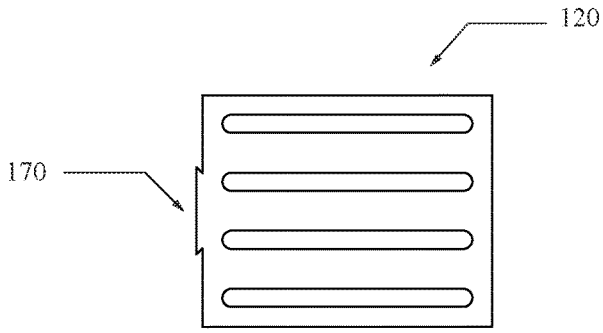
FIG. 7B shows an exemplary top view of one embodiment of the auxiliary member of the game table system.

The some embodiments, as shown in FIG. 5, may include a chamfered corner 155 wherein the first attachment member 150 is located and protrudes into the perimeter edge 110B of the table top 110.

In some embodiments, a length of the leg 140 is adjustable by the user. For example, the leg member 130 may further comprise a spring-loaded member wherein a telescoping assembly may be variably adjusted to match a desired height of the table top 110 relative to a ground surface the game table system 100 is resting upon. In some embodiments, the leg 140 may comprise dimensions to accommodate a wheelchair. A wheelchair commonly having overall dimensions of a length of about 42" (106.7 cm), a height of about 36" (91.4 cm) and having a seat height about 19.5" (49.5 cm), and a seat width about 25" (63.5 cm).

As shown in FIGS. 5A, 5B, 6A and 6B, in some embodiments, a support bracket 125 is adjoined to the table top 110 through the first attachment member 150, as desired by the user. In some embodiments, the shape of the support bracket 125 matches the shape of the auxiliary member 120 of the game table system 100. For example, when the auxiliary member 120 is rectangular, the support bracket 125 may be comprised of an L-shaped design to wrap around, and otherwise support from beneath the auxiliary member 120 and to provide overhung weight support to the auxiliary member 120 attached to the perimeter edge 100B of the table top 110. In other embodiments, the support bracket 125 may further comprise at least one fourth attachment 165 member designed to interface with the first attachment member 150 or the third attachment member 175 of a leg member 130. In another embodiment, the support bracket 125 is not required. In some embodiments, the support bracket 125 and/or the fourth attachment member may interface with a support slot 190 protruding into the first attachment member 150 and/or the table top 110.

Figure 9A:
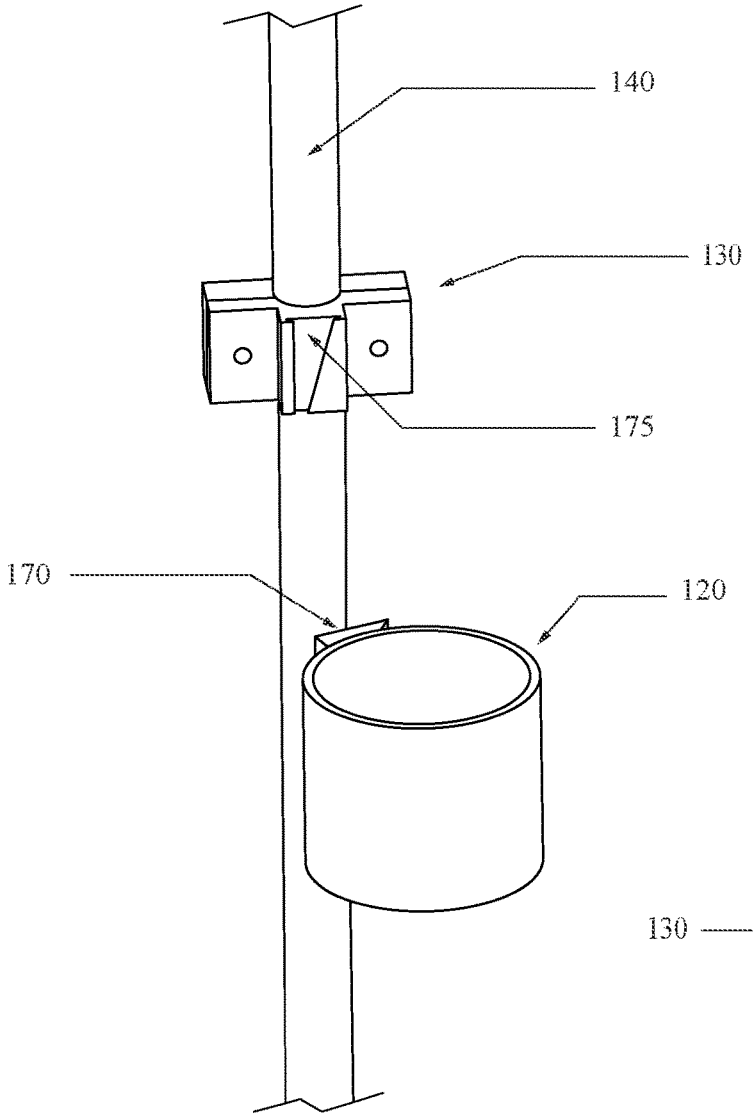
FIG. 9A shows an exemplary isometric view of one embodiment of the leg member upon a leg of the game table system.
Figure 9B:
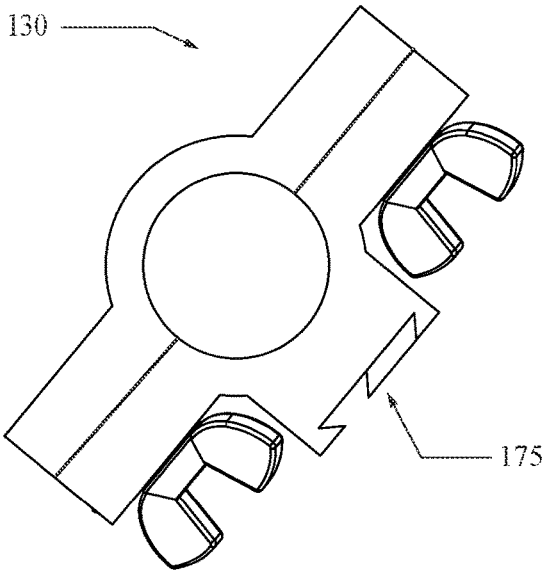
FIG. 9B shows an exemplary top view of one embodiment of the leg member of the game table system.
Figure 10:
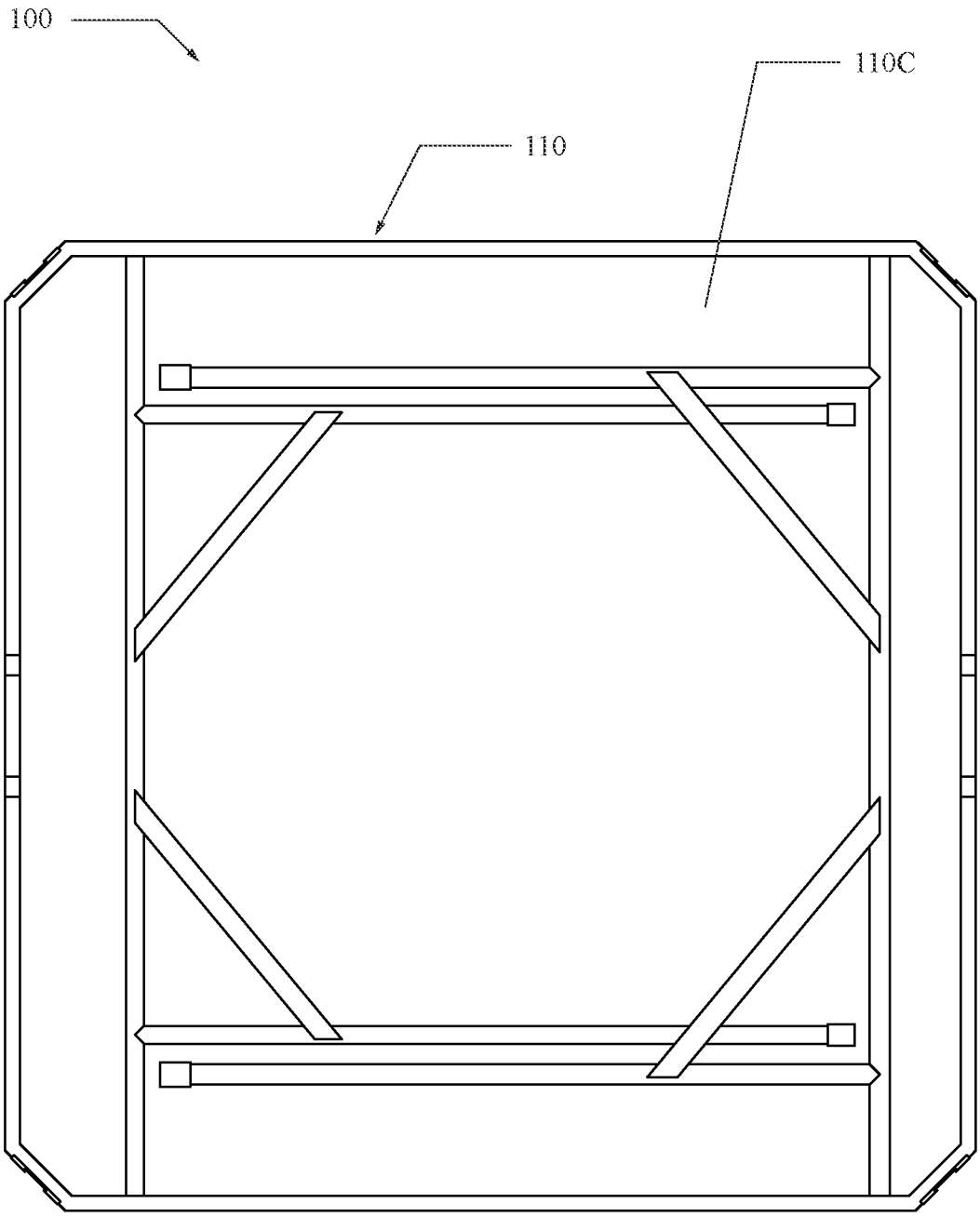
FIG. 10 shows an exemplary bottom view of one embodiment of the game table system.

As shown in FIG. 9A and FIG. 9B, the user may further desire custom configuration and attachment of the auxiliary member 120 upon the leg 140 of the game table system 100. In some embodiments, the leg 140 further comprising a leg member 130 having at least one third attachment member 175 and wherein the leg member 130 is adjoined to at least one of the at least four legs 140. For example, a cupholder embodiment of the auxiliary member 120 may be located at a level below to top surface 110A of the table top 110 to avoid spilling upon the top surface 110A. During exemplary operation, the at least one second attachment member 170 of the at least one auxiliary member 120 interfaces to the at least one third attachment member 175 of the leg member 140 during assembly by the user.

Figure 11:
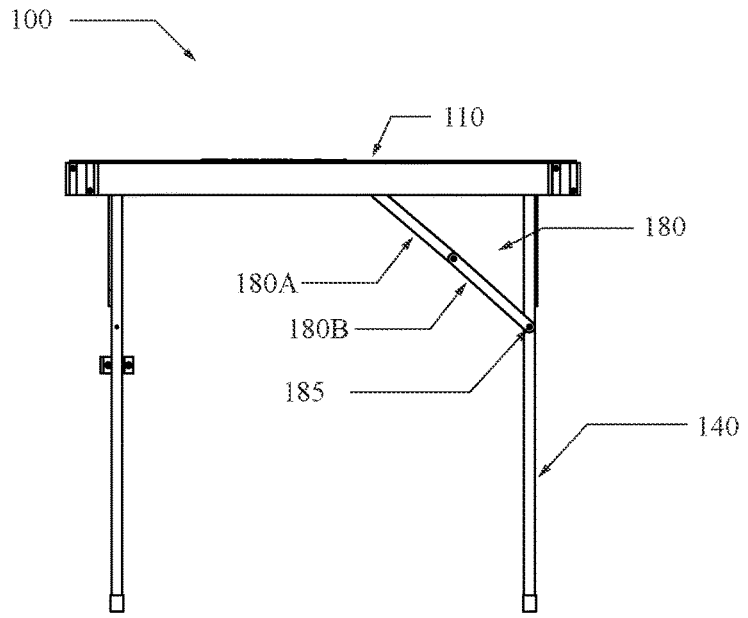
FIG. 11 shows an exemplary front view of one embodiment of the game table system.
Figure 12:
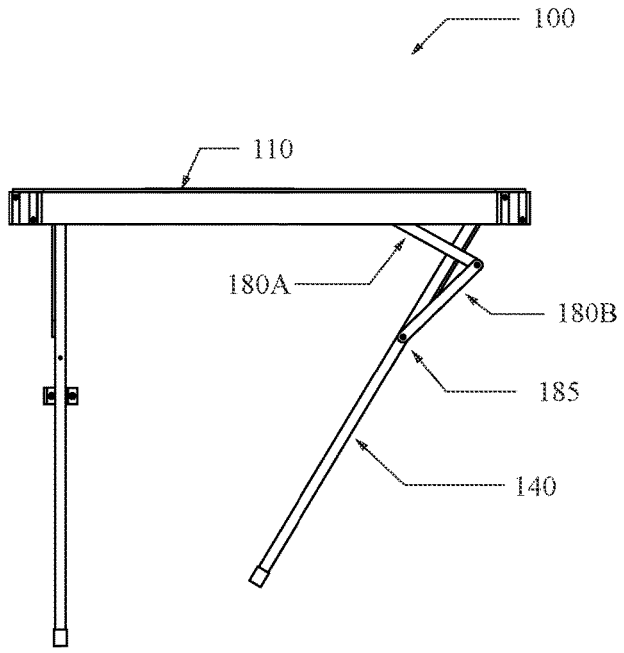
FIG. 12 shows an exemplary front view of one embodiment of the game table system.

As shown in FIGS. 11 and 12, the game table system 100 may comprise a folding bracket 180 having a first half 180A and a second half 180B. During assembly or disassembly of the game table system 100 when the leg 140 is rotated the about the table top 110, the first half 180A and a second half 180B may rotate and fold inward to collapse to a position parallel with the table top 110 when in the leg 140 is also folded to a position parallel with the table top 110. The folding bracket is adjoined to the leg 140 by a joint 185. In some embodiments, a length of the folding bracket 180 may limit a maximum angle of rotation the leg 140 may rotate relative to the table top 110. For example, the folding bracket 180 may limit the leg 140 to stop at a position perpendicular or substantially 90 degrees relative to the bottom surface 110C of the table top 110.

Figure 13:
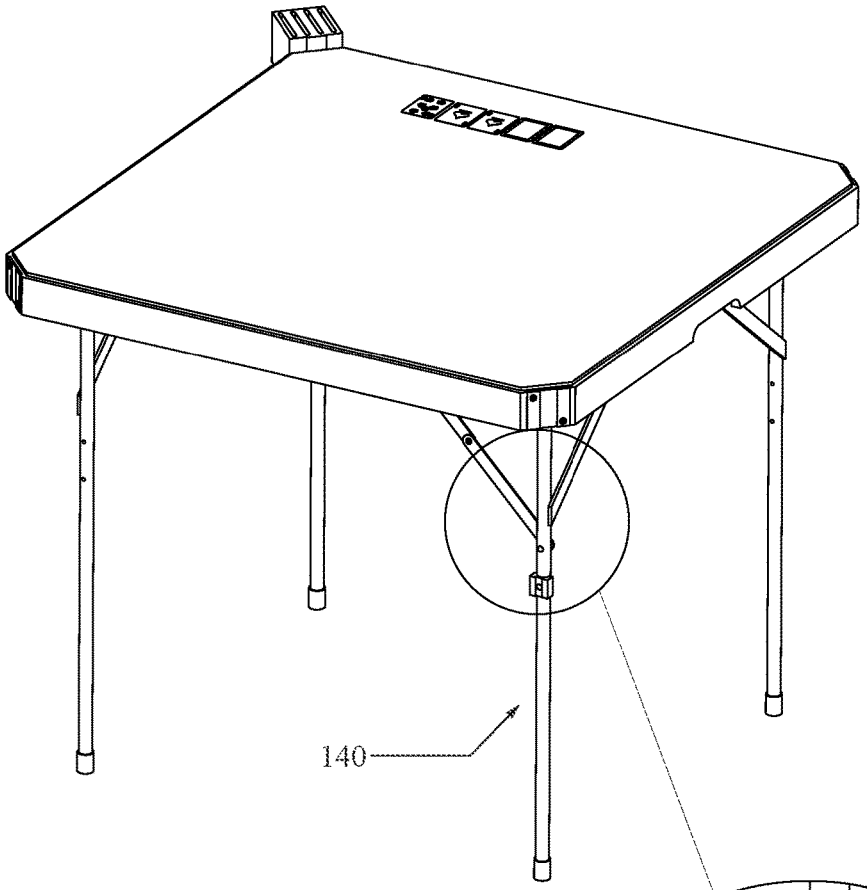
FIG. 13 shows a perspective view of one embodiment of the game table system.
Figure 13D:
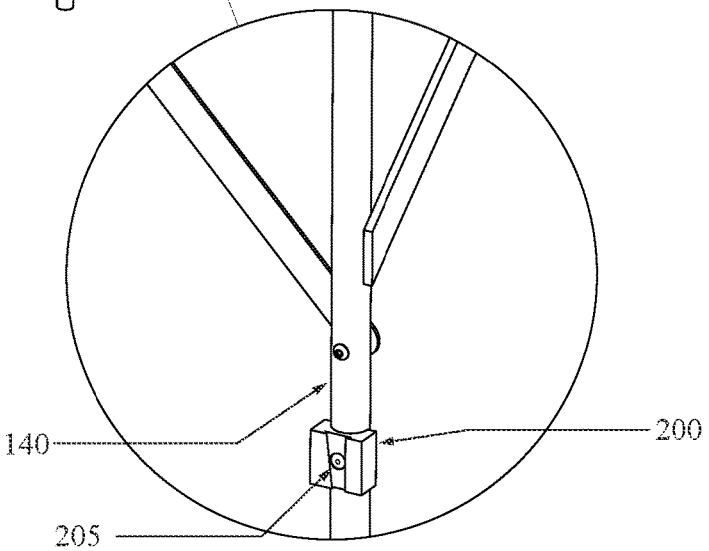
FIG. 13D shows a perspective detail view of one embodiment of the leg of the game table system.

As shown in FIGS. 13 and 13D, the leg 140 of the game table system 100 may further comprise a secondary leg member 200 designed to engage with the auxiliary member 120 or the at least one second attachment member 170 of the at least one auxiliary member 120. In some embodiments, the secondary leg member 200 is configured to match shape and size of the leg 140. In some embodiments, the secondary leg member 200 is adjoined to the leg 140 by at least one member of the attachment member set, such as a rivet 205.

In various embodiments of the game table system 100, the auxiliary member 120 may comprise one or more members of an auxiliary set including but not limited to a cup holder, a card holder, a magnet, a container, a camera mount, a calculator, a mobile phone holder, a clipboard, a card shuffler, a notepad, a scoreboard, and a receptacle.

In some embodiments, the game table system 100 can be manufactured in other shapes not illustrated including, by way of non-limiting example, a honeycomb shape, a square, a triangle, a circular shape, a shape having at least three flat sides, a rectangle, an octagon, and an oval.

In some embodiments, the game table system 100 provides assistance to the user in holding onto the game table system 100. In some embodiments, the table top 110 and other members of the game table system 100 further comprise an external texture to grip a hand of a human. The external texture further comprising at least one member of a texture set including but not limited to indentations, anti-glare, a fabric texture, extrusions, knurling, a rough surface, and bumps.

In some embodiments, the first attachment member 150, the second attachment member 170, the third attachment member 175, and/or the fourth attachment member 165 of the game table system 100 may comprise at least one member of an attachment member set including but not limited to a slot, a Velcro member, a U-bolt, an adhesive, a rail, a joint, a magnet, an elastic member, a snap-fit, a clamp, rivet, a spring, a lever arm, a clip, and a fastener. In other embodiments, the rail and the joint of the connection set are chosen from, by way of non-limiting example, a rail set consisting of: a dovetail rail, an angled dovetail joint, an angled dovetail rail, a tongue and groove joint, a linear guide rail, a dado joint, and a dovetail joint. One skilled in the art will recognize the first attachment member 150, the second attachment member 170, the third attachment member 175, and/or the fourth attachment member 165 may comprise a male embodiment or a female embodiment corresponding to the first attachment member 150, the second attachment member 170, the third attachment member 175 and/or the fourth attachment member 165.

In some embodiments, the game table system 100 is made of at least one material of a material set including but not limited to a ceramic material, a metal material, a wood material a plastic material, a fiberglass material, an acrylic material, a composite material, a thermoset plastic, a thermoplastic, a glass material, and a nylon material. Exemplary materials of the material set for construction of the game table system include, by way of non-limiting example, the following materials: a High-density polyethylene (HDPE) material, a low-density polyethylene (LDPE), a Polypropylene (PP), a rubber material, a Polyvinyl chloride (PVC) material, a urethane material, a polyurethane material and any other materials commonly used in the construction of folding tables.

In some embodiments, the game table system 100 further comprises at least one member of an identification set including but not limited to an alphanumeric identification, a human user's name, a symbolic shape, a company brand, a numeric identification number, a QR code, a barcode, and an RFID tag. For example, the table top 110 of the game table system 100 may display a QR code associated with the rules of the game of game or the alphanumeric identification of the play at the game table system 100, therein aiding the user in the play of the game upon the game table system 100.

In summary, the present game table system, termed by the inventor a "Bridge Buddy" has created a unique square folding duplicate card table, which is most commonly ideal for a 4 person bridge game. The game table may be 30-40 inches square, in a preferable embodiment, the table is 30¼ inches square, which may be the smallest sized card table on the market. The leg design on the table is original and allows hand pushed wheel chairs or electronic wheel chairs to be comfortably placed partially under the table, as the table is of an appropriate height as previously disclosed. The bridge table has a ¼ inch recessed lip all around the table. This recessed lip will allow the bridge tables to stay securely in place when stacked. The design of the table also prevents the table legs from touching or marring the surface of the bridge table tops when stacked. Additionally, there are two recessed cut outs on opposing sides of the table which allows for easy lifting and carrying.

Typically, the tables are constructed of high-density polyethylene and are strong, light weight and extremely robust. The game table will not crack, chip or peel, and is built for indoor and outdoor use. There is an integrated steel frame design provides a substantial foundation and is protected with a powder-coated, weather-resistant finish. The four corners of the square table house a female dovetail which will allow the bidding boxes to connect to said table. This design allows for a specially designed bridge box, known to the inventor, to easily attach to the corner. The female dovetail will accommodate any bid box, and/or utility boxes designed by the inventor. There may be other boxes available to be used with the novel corners of the present game table, attaching via a variety of metal straps.

Of specific importance, after the steel frame was installed, an additional micro laser procedure may be used on the table top, resulting in a leather texture design. The texturing process provides a quality appearance to the surface as well as a no skid surface that feels pleasant to the players. In one embodiment, once the micro-laser process is complete; another procedure may be added called "Micro Matte". This is a technique developed to achieve and maintain low gloss finishes on plastic blow molded parts, without altering the visual appearance of the base texture. Micro Matte is a micro-laser generated overlay technology developed by Mold-Tech, Inc. and translated to in-mold texturing applications. Micro Matte diffuses the reflective light on the molded part resulting in low gloss; rich realistic texture finishes on all types of plastics. Dimensions and sizes of the game table may include, but is not limited by the following; (table legs open open) 30½, L×30⅛, W×28" H, (table with folded legs): 30½ L×2.25" W×30⅛" H. The table top material may include UV-Protected High-Density Polyethylene (HDPE). The table top thickness may be 2.2" (57 mm), the frame material may be powder-coated steel leg tubing diameter may be 1 inch (28 mm), while the weight may be 15 lbs. When the steel mold was completed, we added another micro laser procedure, resulting in a leather texture design inside the mold. The texturing process provides a quality appearance to the surface and the pleasantness of the feel are the main reasons, we implemented this procedure. When the texturing process was completed; another procedure was added called "Micro Matte'. This is a technique developed to achieve and maintain low gloss finishes on plastic blow molded parts, without altering the visual appearance of the base texture. Micro Matte is a micro-laser generated overlay technology developed by Mold-Tech and translated to in-mold texturing applications. Micro Matte diffuses the reflective light on the molded part resulting in low gloss; rich realistic texture finishes on all types of plastics. Perfect for bridge and card players. Our table will become the standard in bridge and every table, with basic common sense care, should last for 20 years plus.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A game table system comprising:

a table top having a top surface, a bottom surface and a perimeter edge, the perimeter edge having a height;

at least four legs rotatably adjoined to the bottom surface;

at least one first attachment member adjoined to and extending substantially across the height of the perimeter edge, the at least one first attachment member comprising a female portion of a dovetail joint;

at least one auxiliary member having a side and at least one second attachment member, the at least one second attachment member adjoined to the side and comprising a male portion of the dovetail joint; and a slot enabled to accept a support bracket, adjacent to and directly under the female portion;

wherein a first mode of operation the male portion of the dovetail joint of the at least one second attachment member interfaces with the female portion of the dovetail joint of the at least one first attachment member during assembly by a user, the first mode of operation creating a complete dovetail joint securing the side of the auxiliary member to the perimeter edge without the attachment members or auxillary member intruding on a surface area of the top surface.

2. The game table system of claim 1, wherein the table top further comprises a lip extending into the top surface of the table top and shaped to substantially match the perimeter edge; and wherein the lip allows the user to stack multiple units of the game table system in a flush manner.

3. The game table system of claim 1, wherein a length of the at least four legs are adjustable by the user.

4. The game table system of claim 1, wherein the table top further comprises an external texture.

5. The game table system of claim 1, wherein the table top further comprises at least one handle slot protruding into the table top and configured to grip a hand of a human.

6. The game table system of claim 1, further comprising:

a leg member having at least one third attachment member and adjoined to at least one of the at least four legs wherein the third attachment member does not impede rotation of the at least four legs; and, wherein a second mode of operation the at least one second attachment member of the at least one auxiliary member interfaces to the at least one third attachment member during assembly by the user.

7. The game table system of claim 1, wherein the auxiliary member is one or more of: a bidding box, a cup holder, a card holder, a magnet, a container, a camera mount, a mobile phone holder, a calculator, a clipboard, a card shuffler, a notepad, a scoreboard, or a receptacle.

8. The game table system of claim 1, wherein the table top comprises one shape selected from: a square, a triangle, a circular shape, a shape having at least three flat sides, a rectangle, an octagon, and an oval.

9. The game table system of claim 2, wherein at least one first attachment member protrudes into the perimeter edge of the table top.

10. The game table system of claim 1, further comprising:

at least one support bracket adjoined to the table top and configured to support the at least one auxiliary member during assembly.

11. The game table system of claim 10, further comprising:

at least one fourth attachment member adjoined to the at least one bracket and configured to adjoin to the at least one first attachment member.

12. The game table system of claim 10, wherein the at least one support bracket is L-shaped.

* * * * *